US006601744B2

(12) United States Patent
Altemus

(10) Patent No.: US 6,601,744 B2
(45) Date of Patent: Aug. 5, 2003

(54) SANITARY GLOVE CONTAINER

(76) Inventor: Armin Altemus, 2640 Pleasant St., Riverside, CA (US) 92507

( * ) Notice: Subject to any disclaimer, the term of this patent is extended or adjusted under 35 U.S.C. 154(b) by 0 days.

(21) Appl. No.: 09/859,231

(22) Filed: May 15, 2001

(65) Prior Publication Data

US 2002/0005420 A1 Jan. 17, 2002

Related U.S. Application Data

(60) Provisional application No. 60/204,107, filed on May 15, 2000.

(51) Int. Cl.[7] ..... A45C 1/04

(52) U.S. Cl. ..... 224/235; 224/675; 224/677; 224/679; 224/683; 220/4.21; 220/4.24; 220/375

(58) Field of Search ..... 224/191, 235, 224/665, 671, 673, 674, 675, 677, 679, 682, 683; 220/4.21, 4.24, 4.25, 375

(56) References Cited

U.S. PATENT DOCUMENTS

| | | | | | |
|---|---|---|---|---|---|
| 2,304,896 | A | * | 12/1942 | Doyle | 220/288 |
| 2,343,679 | A | * | 3/1944 | Lermer | 224/222 |
| 2,416,142 | A | * | 2/1947 | Bennett | 138/140 |
| 3,292,252 | A | * | 12/1966 | Reading | 190/124 |
| 3,567,085 | A | * | 3/1971 | Flores | 206/204 |
| 3,870,150 | A | | 3/1975 | Hummel | |
| D245,785 | S | | 9/1977 | Price | |
| D254,719 | S | | 4/1980 | Mascia et al. | |
| D265,022 | S | | 6/1982 | Parker | |
| 4,744,461 | A | * | 5/1988 | Lapham | 206/5 |
| 4,765,501 | A | * | 8/1988 | Kao | 220/4.21 |
| 4,844,293 | A | | 7/1989 | McLaughlin | |
| 4,866,952 | A | * | 9/1989 | Hight et al. | 206/37 |
| 4,993,589 | A | | 2/1991 | McLaughlin | |
| 5,265,785 | A | | 11/1993 | Chudy | |
| D344,312 | S | | 2/1994 | Lamb | |
| 5,392,974 | A | | 2/1995 | Johnson-Rabbett | |
| 5,503,288 | A | * | 4/1996 | Conconi | 220/23.4 |
| 5,573,109 | A | | 11/1996 | Isacson | |
| 6,036,022 | A | | 5/2000 | Young | |
| 6,206,217 | B1 | * | 3/2001 | Chiang | 206/37 |
| 6,253,944 | B1 | * | 7/2001 | Osten | 220/4.24 |

* cited by examiner

*Primary Examiner*—Stephen K. Cronin
(74) *Attorney, Agent, or Firm*—Knobbe, Martens, Olson & Bear, LLP

(57) ABSTRACT

A sanitary glove container assembly and a method for its use that permits the storage of sanitary gloves. The assembly comprises two rounded, hollow members with threaded openings, and the members are joined by a securing mechanism. The area of the openings is smaller than the cross sectional area of the hollow members such that gloves will not fall out inadvertently. The user may individually encapsulate one glove in each hollow member in a manner in order to allow for easy access to the gloves, allow for easy loading of the device, prevent tangling of the gloves, and ensure cleanliness of the glove before use.

42 Claims, 5 Drawing Sheets

SANITARY GLOVE CONTAINER

RELATED APPLICATIONS

This application claims the benefit of U.S. Provisional Patent No. 60/204,107 entitled "PLASTIC GLOVE CONTAINER" and filed on May 15, 2000. This application hereby incorporates the above application by reference.

BACKGROUND OF THE INVENTION

1. Field of the Invention

The present invention relates to sanitary glove containers, and more specifically, to a compact, portable container used to carry one pair of sanitary gloves in a manner which will reduce the chances of damaging the gloves and reduces exposure of the gloves stored therein to contaminants.

2. Description of the Related Art

Medical and rescue workers treat persons in emergency situations on a daily basis. Oftentimes, while treating the victims of these emergency situations, these workers come in close proximity to pathogens that may cause a variety of illnesses. By using sanitary gloves, these emergency workers can effectively limit their exposure to these diseases. Sanitary gloves can also protect the victim from germs that are present on the worker's hands. However, these emergency situations require quick response and split second decision making, and the sanitary gloves may not be readily available. As a result, the medical or emergency worker might have to make the undesirable choice whether to risk exposing themselves or the patient to dangerous pathogens or germs or delay treatment until gloves are acquired.

To address this concern, several different glove containers have been developed. For example, the invention disclosed in U.S. Pat. No. 5,265,785 discloses a device used to hold sanitary gloves. The device disclosed in U.S. Pat. No. 5,265,785 comprises a small, hollow container in which the gloves are stored. The gloves can be accessed and extracted via an aperture through which the gloves can be pulled out of the interior of the container. This device also includes a clip on the back used for attaching the device to the user's belt.

As stated, gloves are extracted from the device disclosed in U.S. Pat. No. 5,265,785 by pulling the gloves through the aperture. This would likely require two fingers at a minimum. However, fitting two fingers into the small aperture would be difficult given the difference in diameters between the aperture and the user's fingers. Thus, extracting gloves from the device disclosed in U.S. Pat. No. 5,265,785 may take too much time, especially when the device is used in a crisis situation. As a result, treatment to the patient may be delayed.

Furthermore, the device disclosed in U.S. Pat. No. 5,265,785 has only one common cavity within which the gloves are stored. Ordinarily, the gloves would be balled inside the cavity for storage. After loading, the gloves may fold into each other because of the glove's natural tendency to expand and unfold when balled up. The user would be unable to see what they are pulling from the device because the small aperture prevents them from doing so. Thus, it is foreseeable that the user might grab two gloves, folded into each other, when the user only intended to grab a single glove. With two or more gloves, the user may be encumbered, and the user might even drop the extra gloves, rendering the dropped gloves contaminated and unusable. This could also delay treatment to the patient.

Also, in order to reduce the chance that more than one glove will be extracted from the device at once would require a careful loading process. More specifically, each individual glove would have to be folded and layered into the device. The user may dislike this time consuming loading process and choose rather to load the device in a conventional manner. In doing so, the user would risk grabbing multiple gloves at once as described above.

Last, the aperture in the device disclosed in U.S. Pat. No. 5,265,785 is permanently open. This open aperture could provide a pathway for contaminants to enter the container and taint the gloves. Therefore, the open aperture in the device disclosed in U.S. Pat. No. 5,265,785 could allow the gloves to become unsanitary.

U.S. Pat. No. 5,392,974 discloses another device that attempts to address the problems stated above. This device comprises a lightweight, collapsible pouch that can attach to the user's belt. The device comprises a large aperture through which gloves are loaded and a separate slit cut lengthwise in the pouch through which gloves are unloaded. The device also comprises a flap that can detachably cover both the loading aperture and the unloading slit.

As stated, the flap on the device disclosed in U.S. Pat. No. 5,392,974 covers both the aperture and the unloading slit; however it does not completely seal the two openings. Thus, this device also provides an open pathway for foreign particles and germs to enter the container and taint the gloves contained therein. Furthermore, the pouch disclosed in U.S. Pat. No. 5,392,974 comprises a single cavity used to collectively store the gloves. As stated above with regards to U.S. Pat. No. 5,265,785, this could cause the user to inadvertently grab two or more gloves at once and the user might drop a glove as a result and render it unusable.

Hence, from the foregoing, it will be appreciated that there is a need for a lightweight, portable container used for transporting sanitary gloves that is easy to load and unload and that ensures the gloves will stay in a sanitary condition.

SUMMARY OF THE INVENTION

The sanitary glove container assembly of the present invention satisfies the aforementioned needs because it is a lightweight, portable container that encloses and secures the gloves in a protective environment.

In one embodiment, the container assembly comprises a first hollow member which defines a first inner space. The first hollow member comprises a first opening at a first end of the first hollow member, and the area of the first opening is sufficiently large such that a sanitary glove can be positioned therethrough, and the sanitary glove can be retained within the first inner space.

Similarly, the container comprises a second hollow member, which defines a second inner space. The second hollow member also comprises a second opening at a second end of the second hollow member, and the area of the second opening is sufficiently large such that a sanitary glove can be positioned therethrough, and the sanitary glove can be retained within the second inner space.

The container assembly also comprises a securing mechanism that secures the first end of the first hollow member to the second end of the second hollow member so that when the securing mechanism is engaged, the first and second inner spaces define a single enclosed protected environment for the sanitary gloves.

Advantageously, this embodiment of the present invention allows the user to transport gloves in a sanitary enclosed environment where they are unlikely to be contaminated.

In another embodiment, the container assembly of the present invention comprises a first member defining a first recess that is sized so as to receive a first sanitary glove. The first member includes a first neck portion that defines a first opening that is sized so as to inhibit the first sanitary glove from falling out of the first recess.

The container assembly also comprises a second member defining a second recess that is sized so as to receive a second sanitary glove. The second member includes a second neck portion that defines a second opening that is sized so as to inhibit the second sanitary glove from falling out of the second recess.

Also, the first and second neck portions of the first and second members are configured to be interconnected together such that the first and second openings are closed so as to inhibit entry of foreign particles into the first and second recesses.

In this embodiment, a sanitary glove can be individually positioned and retained within both the first and second recess as a result of the decreased area of the first and second openings. This inhibits a glove from falling from the open container assembly inadvertently, and, advantageously, this increases the likelihood that the sanitary glove will remain uncontaminated. This also inhibits a glove from moving from its respective recess to its neighboring recess when the closed container assembly is closed. This results in individual encapsulation of the glove, which is advantageous because this ensures that the user will easily be able to load and unload the device. Separate encapsulation of the sanitary gloves also allows the user to put on the gloves in a more sanitary manner.

Another embodiment of the present invention comprises a method of storing sanitary gloves for transporting. A first step involves positioning a sanitary glove inside a first hollow member through a first opening in the first hollow member and into a first recess. The area of the first opening is smaller than the cross sectional area of the first recess such that the sanitary glove is prevented from escaping the first hollow member.

A second step involves positioning a sanitary glove inside a second hollow member through a second opening in the second hollow member and into a second recess. The area of the second opening is smaller than the cross sectional area of the second recess such that the sanitary glove is prevented from escaping the second hollow member.

A third step involves joining the first hollow member to the second hollow member with a securing mechanism to define a single enclosed protected environment that protects the gloves from foreign contaminating particles. This also individually encapsulates the sanitary gloves and isolates the sanitary glove contained in the first hollow member from the sanitary glove contained in the second hollow member and vice versa.

Advantageously, using this method enables the user to transport gloves in a sanitary, enclosed environment where the gloves are unlikely to be contaminated. Also, the gloves are likely to remain sanitary even when the container assembly is open because the container assembly inhibits the gloves from falling out. Last, the container assembly allows for quick and sanitary loading and unloading because the gloves are individually encapsulated.

These and other objects and advantages of the present invention will become more fully apparent from the following description taken in conjunction with the accompanying drawings.

DETAILED DESCRIPTION OF THE PREFERRED EMBODIMENT

Figure 1:
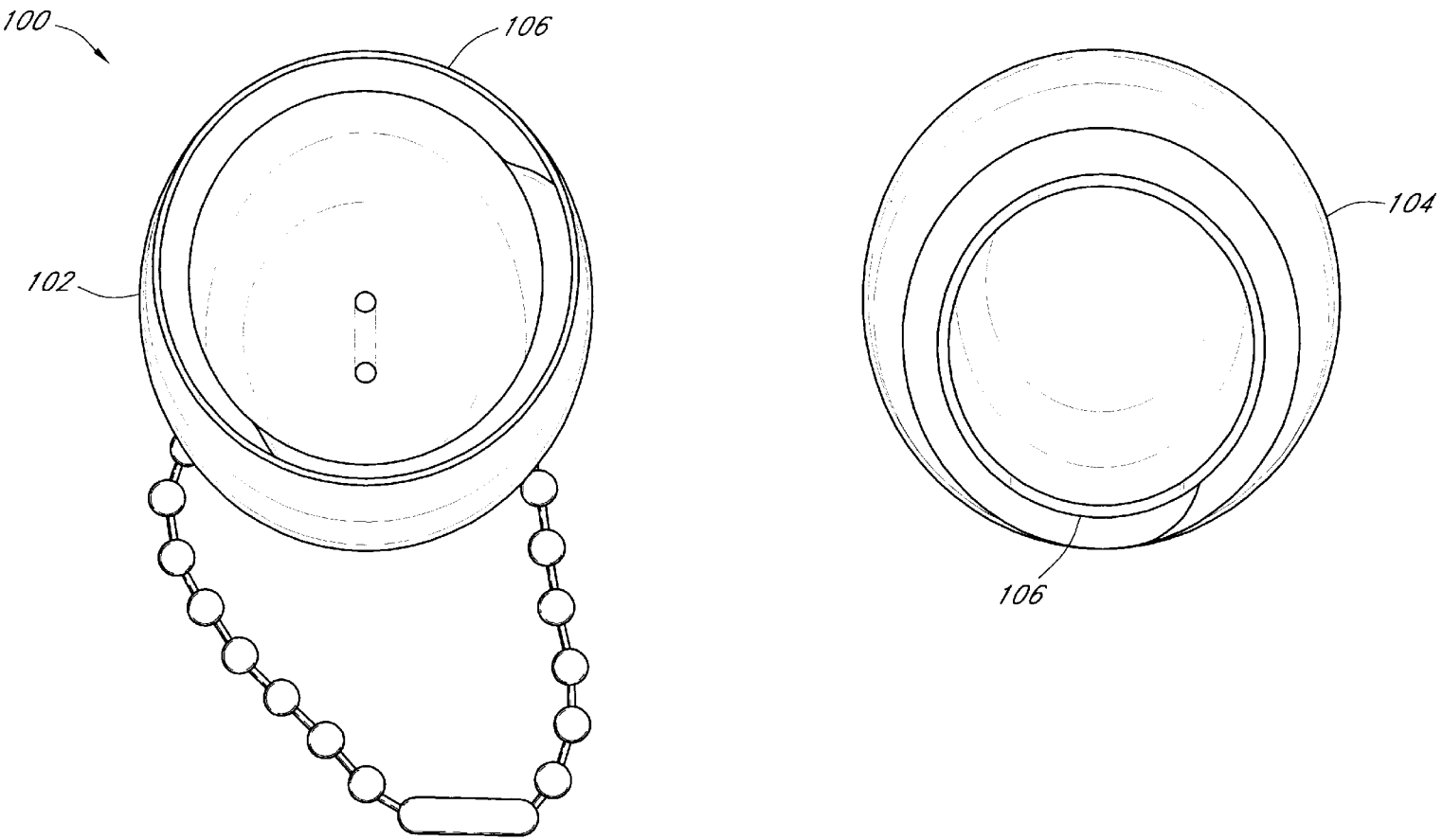
FIG. 1 is a perspective view of the sanitary glove container assembly constructed according to one embodiment of the present invention.

Reference will now be made to the drawings wherein like numerals refer to like parts throughout. Referring to FIG. 1, one embodiment of the present invention is shown as a sanitary glove container assembly 100. As shown, the container assembly 100 generally comprises a first hollow member 102 and a second hollow member 104 that can be joined by a securing mechanism 106. As will be discussed in greater detail below, a sanitary article, such as a glove, can be stored separately inside the first and second hollow members 102, 104, and the securing mechanism 106 ensures that the pair of sanitary gloves are enclosed by the first and second hollow members 102, 104 so as to keep foreign particles out.

Figure 2:
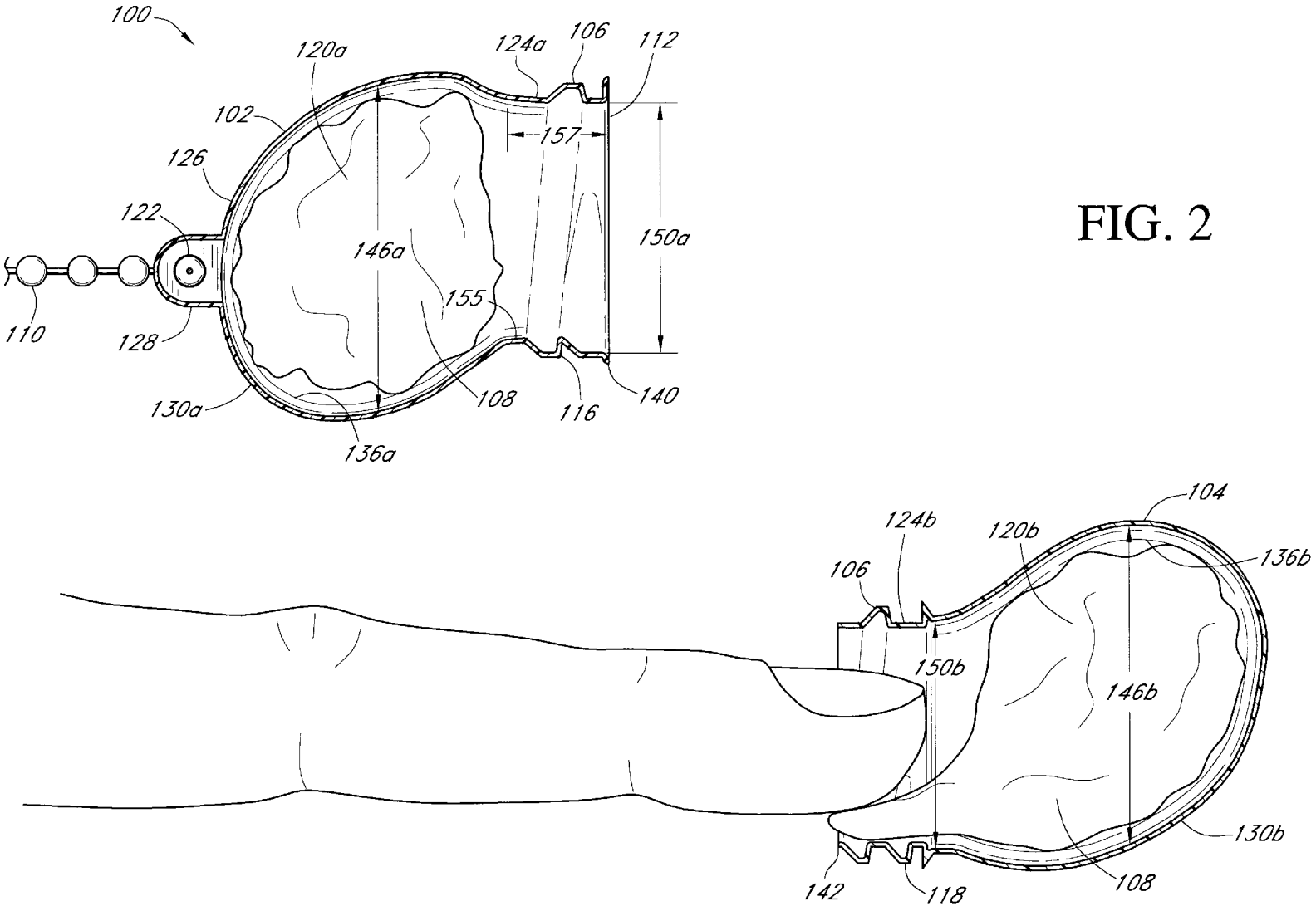
FIG. 2 is a cross sectional view of the glove holder of FIG. 1 taken along its longitudinal axis.

One embodiment of the first and second hollow members 102, 104 is shown in FIG. 2. Both the first and second hollow members 102, 104 comprise a rounded outer surface 130*a*, 130*b*. Likewise, both the first and second hollow members 102, 104 comprise a rounded inner surface 136*a*, 136*b* which defines a storage area 120*a*, 120*b*. The storage area 120*a*, 120*b* has a designated cross sectional area 146*a*, 146*b*. In the preferred embodiment, the first and second storage area 120, 122 are sized so that a sanitary glove 108 can be individually stored in each storage area 120, 122.

As FIG. 2 illustrates, the first hollow member 102 has a first opening 112 at a first end 140 and the second hollow member 104 has a second opening 114 at a second end 142. Preferably, the first and second openings 112, 114 are large enough to allow the user to grab the sanitary glove 108 and pull it out. In one embodiment, both the first and second openings 112, 114 are circular, and the area of the first and second openings 112, 114 is slightly larger than the diameter of an average finger. Also, the first and second openings 112, 114 are preferably sized such that the glove 108 must be compressed in order to pass it through the first and second openings 112, 114. This feature inhibits the glove 108 from inadvertently falling out of the first and second hollow members 102, 104 in a manner to be described in greater detail below. As such, the sizing of the openings 112, 114 allows easy access to the glove 108, yet inhibits the glove's 108 ability to inadvertently fall out of the hollow members 102, 104.

FIG. 2 also shows that, in one embodiment, the first and second hollow members 102, 104 both comprise a neck section 124*a*, 124*b*, which connects the storage areas 120*a*, 120*b* to their respective openings 112, 114. In one embodiment, the neck section 124*a*, 124*b* is cylindrically shaped so as to define an inner surface 155 with a specific cross sectional area 150*a*, 150*b*. In this embodiment, this cross sectional area 150*a*, 150*b* defines the size of the first and second openings 112, 114. Thus, as stated in relation to the size of the openings 112, 114, the cross sectional area 150*a*, 150*b* of the neck section 124*a*, 124*b* is preferably wide enough to allow the user to grab the sanitary glove 108 and pull it out. Also, the cross sectional area 150*a*, 150*b* of the neck section 124*a*, 124*b* is preferably sized such that the glove 108 must be compressed in order to pass it through the neck section 124*a,* 124*b.* As stated above in relation to the size of the openings 112, 114, this feature inhibits the glove 108 from falling out of the first and second hollow members 102, 104 inadvertently in a manner to be described in greater detail below.

As shown in FIG. 2, the cross sectional area 150*a,* 150*b* of the neck section and openings 112, 114 is smaller than the cross sectional area 146*a,* 146*b* of the first and second storage areas 120, 122. More specifically, average cross sectional area 150*a*, 150*b* of the neck section 124*a,* 124*b* and openings 112, 114 is approximately 0.58 $in^2$ as compared to the average cross sectional area 146*a,* 146*b* of the storage area 120*a,* 120*b*, which is approximately 1.15 $in^2$ in this embodiment. This difference in areas inhibits the glove 108 from falling out of the first and second hollow members 102, 104 inadvertently in a manner to be described in greater detail below.

When loading the first hollow member 102, the user must compress the glove 108 and pass it through the first opening 112, through the neck section 124*a* and press the glove 108 into the first storage area 120*a*. Then, due to the natural elasticity of the glove 108, it will rebound from its compressed state and press into the inner surface 136*a* of the first hollow member 102. It is unlikely that the glove 108 will compress on its own to the point that it can slide through the neck section 124*a,* or past the first opening 112. Thus, the reduced cross sectional area 150*a* of the neck section 124*a* and the opening 112 inhibits the ability of the glove 108 to fall out of the first hollow member 102 inadvertently.

Additionally, as stated, the glove 108 must be compressed in order to pass through the opening 102 and the neck section 124*a,* and once inside the storage area 120*a,* the glove 108 will expand and press against the inner surface 136*a* due to its natural elasticity. As the cross sectional area 150*a* of the neck section 124*a* is reduced, the surface area of the inner surface 136*a* of the storage area 120*a* increases. This provides more surface area for the glove 108 to press against, and as a result, more frictional force is applied to the glove 108 from the inner surface 136*a* to thereby retain the glove 108. Thus, due to the reduced area 150*a* of the neck section 124*a* and the first opening 112, the glove is less likely to fall out of the first hollow member 102 inadvertently.

Advantageously, because the reduced area 150*a* of the neck section 124*a* and the first opening 112 inhibits the glove 108 to fall from the first hollow member 102, the glove 108 is more likely to remain in a sanitary state. (It is understood that the same functionality and advantage is present in the second hollow member 104 due to the reduced area of the second opening 114.)

FIG. 2 shows that the neck section 124*a,* 124*b* interposes a distance 157 between the storage area 120*a,* 120*b* and the openings 112, 114. Thus, in order to escape from its respective storage area 120*a,* 120*b,* the glove 108 must travel along the entire distance 157 of the neck section 124*a,* 124*b,* and it must be compressed the entire way. It is unlikely that the glove 108 will do this on its own because the inner surface 155 of the neck section 124*a,* 124*b* will induce friction forces on the glove 108 to thereby inhibit the glove's 108 movement along the distance 157. Similarly, the glove 108 is unlikely to extend partially out of the hollow members 102, 104 because the friction forces caused by the inner surface 155 of the neck section 124*a,* 124*b* will inhibit this partial movement along the distance 157. Therefore, the glove is more likely to stay completely inside the hollow members 102, 104 until the user intentionally takes it out. Advantageously, because the interposed distance 157 further inhibits the glove from escaping or partially extending from the hollow members 102, 104, the glove is more likely to stay sanitary.

As shown in FIG. 2, the first hollow member 102 further comprises a first threaded member 116 adjacent the first opening 112 on the outer surface 130*a*. The first threaded member 116 is an annular protrusion having grooved threads formed around the periphery of the first opening 112. Similarly, the second hollow member 104 further comprises a second threaded member 118 adjacent the second opening 114 on the outer surface 130*b*. The second threaded member 118 is an annular protrusion having projected threads formed around the periphery of the second opening 114. As will be discussed in greater detail below, the first threaded member 116 and the second threaded member 118 constitute one embodiment of the securing mechanism 106 because the threaded members 116, 118 mate together to join the first and second hollow members 102, 104 thereby enclosing the gloves 108 in a protected environment.

Also shown in FIG. 2 is a mount 128, which is a thin tab of material in the shape of a half circle. The mount 128 is shown attached to a third end 126 of the first hollow member 102; however, it will be appreciated that the mount 128 could be attached to the second hollow member 104 in a similar manner and still be effectively. As will be described below, the mount 128 provides a point of attachment such that the container assembly 100 can be portably attached to the user or the user's belongings.

A round aperture 122 passes through the center of the mount 128 as shown in FIG. 2. Preferably, the aperture 122 is large enough to allow a beaded chain 110 to pass through the mount 128. As will be described in greater detail below, the beaded chain 110 is attached to the user or the user's clothing for portability purposes.

Figure 3:
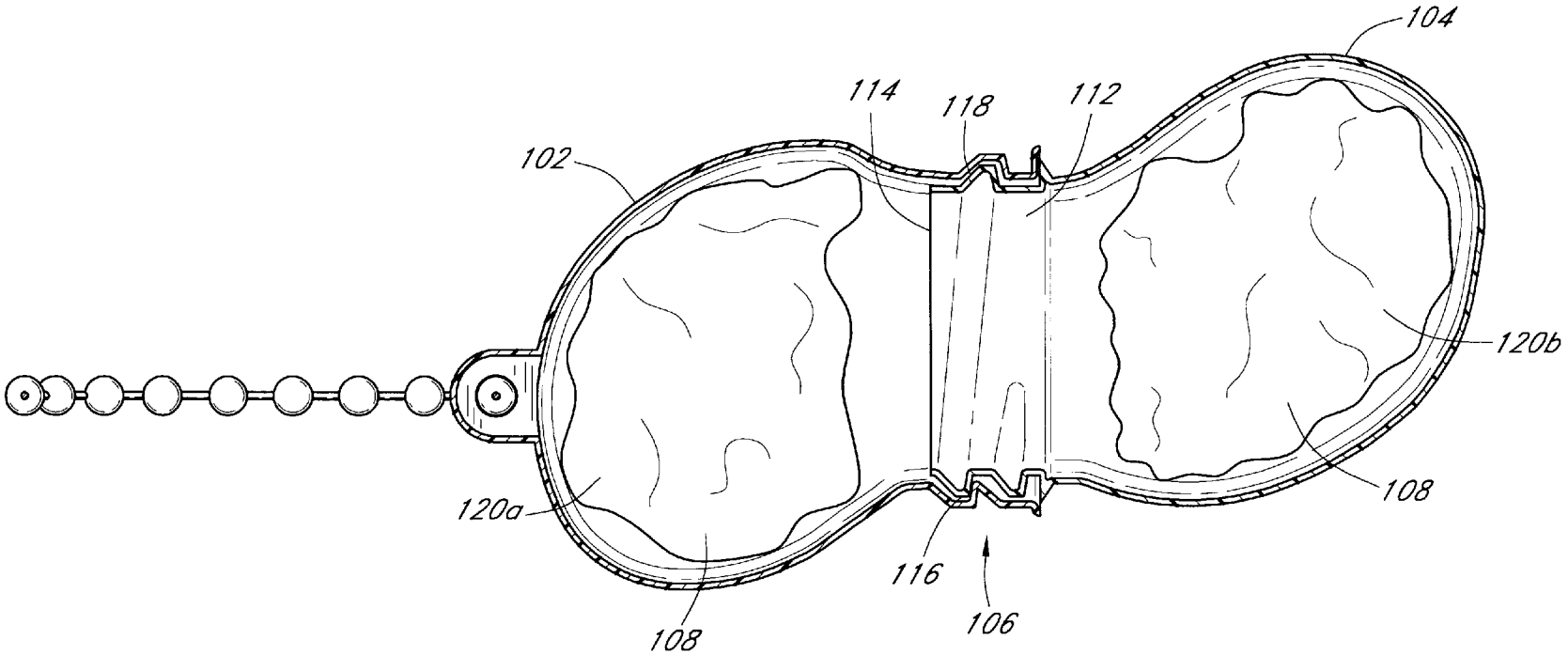
FIG. 3 is a cross sectional view of the glove holder of FIG. 1 taken along its longitudinal axis.

FIG. 3 illustrates the first and second hollow members 102, 104 mated together by way of the securing mechanism 106. To join the first and second hollow member 102, 104 the diameter of the second opening 114 and neck section 124*b* is sized to be slightly smaller than the diameter of the first opening 112 and neck section 124*a*. By inserting the smaller neck section 124*b* through the first opening 112 and into the larger neck section 124*a,* the first and second hollow members 102, 104 are joined. As such, the inner diameter of the first opening 112 is preferably sized so that the outer diameter of the second opening 114 contacts and substantially seals off the first opening 112. In one embodiment to achieve this type of fit, the first opening 112 has a diameter of 0.92 inch and the second opening 114 has a diameter of 0.80 inch.

As discussed above, one embodiment of securing mechanism 116 comprises a first threaded member 116 on the first hollow member 102 and a second threaded member 118 on the second hollow member. In this embodiment, the grooved threads of the first threaded member 116 engage with the projected threads of the second threaded member 118. Preferably, once the securing mechanism 106 is fully engaged, the inner diameter of the first opening 112 is completely sealed by the neck section 124*b* of the second hollow member 104, and the second opening 114 is left open only to the first storage area 120*a*. As such, the first and second hollow members 102, 104, and thus the interior of the container assembly 100, are sealed off from the outside, creating a protected environment for the gloves 108 to reside in. Advantageously, the gloves 108 are more likely to be clean and ready for use whenever needed because foreign particles are unlikely to enter the hollow members 102, 104 when the securing mechanism 106 joins them.

In the preferred embodiment, the threaded members 116, 118 are designed such that when gloves 108 are needed, the user must simply turn the first hollow member 102 one turn opposite to the second hollow member 104. This disengages the securing mechanism 106, and the user can then reach into the hollow members 102, 104 and put on the gloves 108. Therefore, the securing mechanism 106 allows for quick unloading of the sanitary glove container assembly 100. As stated, quick access to the gloves 108 is crucial during emergency situations in which the user is likely to be involved. Advantageously, the quickly opening securing mechanism 106 ensures this quick access to the gloves 108.

As stated above, due to the reduced area 150*a*, 150*b* of the neck section 124*a*, 124*b* and the openings 112, 114, the glove 108 is not likely to move inadvertently from its respective storage area 120*a*, 120*b*. Thus, when the hollow members 102, 104 are joined, the glove 108 is unlikely to move from its respective storage area 120*a*, 120*b* to the neighboring storage area 120*a*, 120*b*, thereby ensuring separate encapsulation of the gloves 108. Separate encapsulation of the gloves 108 presents several advantages.

First, separate encapsulation of the gloves 108 makes it very easy to load the container assembly 100. The user simply must slide a glove 108 into each respective hollow member 102, 104. The user does not have to specially fold the gloves 108 in any particular manner. Regardless of how they are loaded, the gloves 108 are unlikely to tangle together because of this separate encapsulation.

A second advantage involves unloading the device. As stated, there is little chance for the gloves 108 to tangle because they are separately encapsulated. Therefore, there is little chance that the user will inadvertently grab two gloves 108 when needed. Instead, the user will likely only grab one glove, and the other glove 108 will remain encapsulated inside its respective hollow member 102, 104. This further ensures that the gloves 108 will remain sanitary.

Third, it is foreseeable that the user may individually drop one of the hollow members 102, 104 with the glove 108 inside. As stated above, the reduced area 150*a*, 150*b* of the neck section 124*a*, 124*b* and the openings 112, 114 inhibits the glove 108 from slipping out of its respective hollow member 102, 104 on its own. Thus, the glove 108 likely will remains inside its respective hollow member 102, 104, even if dropped. As such, the outer surfaces 130*a*, 130*b* provides a protective barrier between the glove 108 and germs or foreign objects outside the hollow members 102, 104 that may taint or tear the glove 108. Advantageously, the glove is more likely to remain in its sanitary state due to this separate encapsulation inside separate hollow members 102, 104.

A last advantage of separate encapsulation of the gloves 108 is evident when attempting to put on the gloves 108. For example, the user can set down the first hollow member 102 with the glove 108 inside while the glove 108 from the second hollow member 104 is put on and vice versa. Even though the first hollow member 102 is set down, the outer surface 130*a* of the first hollow member 102 acts as a barrier from germs and foreign particles, and the glove 108 is unlikely to fall out of the first hollow member 102 due to the reduced area 150*a* of the neck section 150*a* and the first opening 112. Advantageously, the user can put on one glove 108 unencumbered with the knowledge that the other glove 108 is likely to remain sanitary.

Figure 4A:
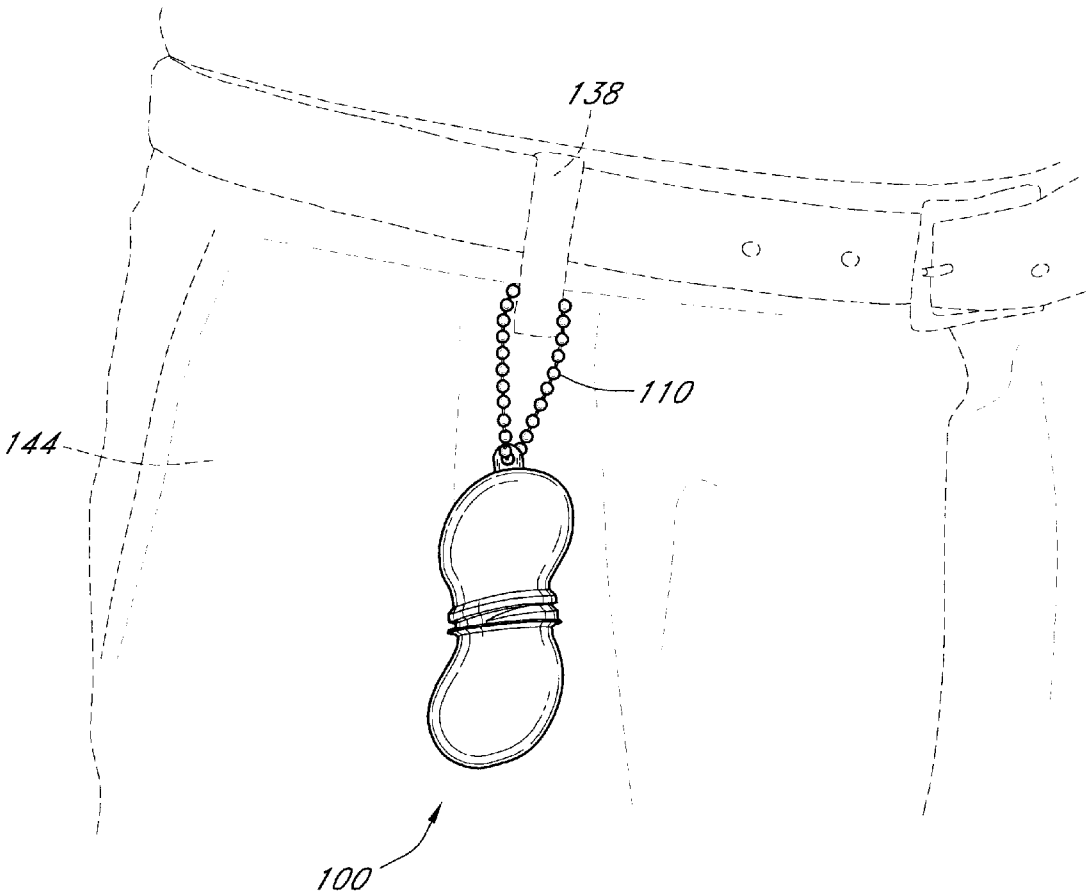
FIGS. 4A and 4B are perspective views of the assembly of FIG. 1, FIG. 2, and FIG. 3 showing the manner in which the sanitary glove holder is used.
Figure 4B:
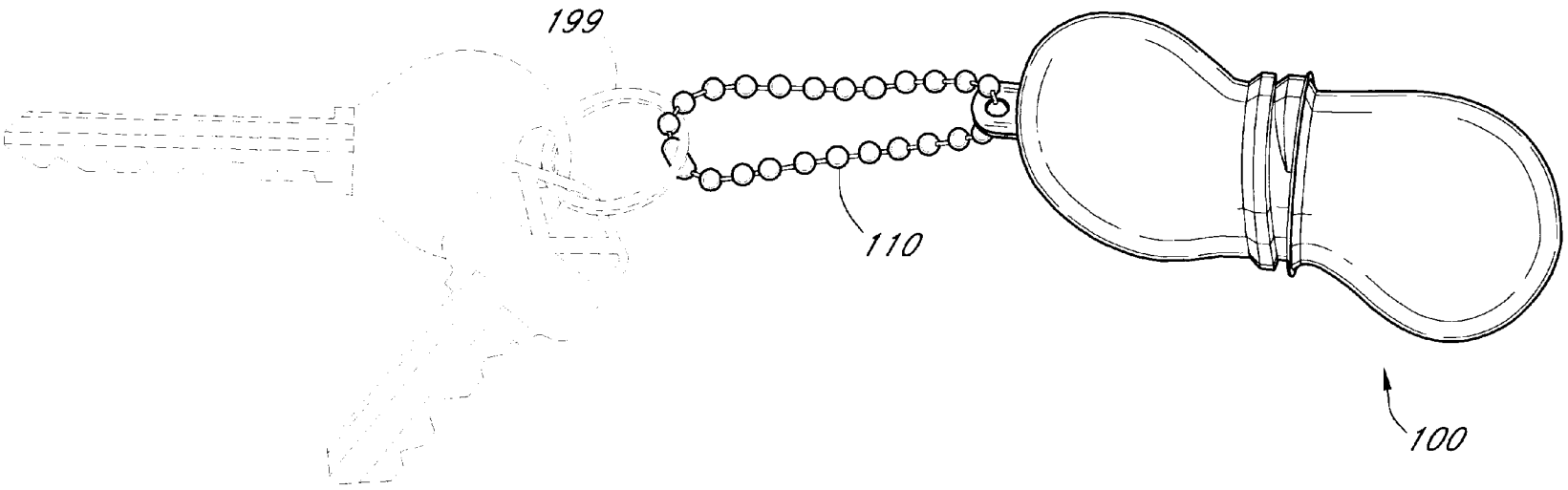

FIGS. 4A and 4B illustrate the sanitary glove container 100 of the preferred embodiment being used. As shown in FIG. 4A, the beaded chain 110 can be secured around a belt loop 138 of a user 144. Then, the user 144 is free to transport the glove container 100 and the gloves 108 contained therein. As shown in FIG. 4B, the beaded chain 110 may be alternatively attached to a key chain 199 if the user 144 has no belt loop 138. In the preferred embodiment, the container assembly 100 is small, comprising a volume of approximately one fluid ounce. It is also light, with a loaded weight of approximately one ounce. Advantageously, the small volume and weight of the container assembly 100 ensures that the user 144 will be left unencumbered.

As stated, the user 144 advantageously can easily load the container assembly 100 by simply slipping one glove 108 in each of the hollow members 102, 104 thereby individually encapsulating the gloves 108. Also advantageous is that the user 144 can easily unload the assembly 100 by disengaging the securing mechanism 106 with one full turn and reaching into the hollow members 102, 104, assured that only one glove 108 will be grabbed at a time. As is also shown in FIG. 4, the assembly 100 completely closes the gloves 108 contained therein to thereby reduce the chances that the gloves 108 will become contaminated. Similarly, even when the hollow members 102, 104 are separated from each other, the hard outer surface 130*a*, 130*b* of the hollow members 102, 104 will give a level of protection to the glove 108 contained therein and will reduce the chances of the glove 108 falling out under its own weight. Lastly, the user 144 is able to put the gloves 108 on in a sanitary manner because one glove 108 can be put on while the other glove 108 sits protected inside its respective hollow member 102, 104.

Although the foregoing description of the preferred embodiment of the present invention has shown, described and pointed out the fundamental novel features of the invention, it will be understood that various omissions, substitutions, and changes in the form of the detail of the apparatus as illustrated as well as the uses thereof, may be made by those skilled in the art, without departing from the spirit of the invention. Consequently, the scope of the invention should not be limited to the foregoing discussions, but should be defined by the appended claims.

What is claimed is:

1. An enclosure for retaining sanitary gloves in a protected environment, the enclosure comprising:

a first hollow member defining a first inner space and having a first opening at a first end of the first hollow member, wherein the area of the first opening is sufficiently large such that a sanitary glove can be positioned therethrough, and wherein the cross-sectional area of the first opening is at least smaller than the cross-sectional area of the first hollow member such that the sanitary glove can be retained within the first inner space via the first opening;

a second hollow member defining a second inner space and having a second opening at the second end of the second hollow member, wherein the area of the second opening is sufficiently large such that a sanitary glove can be positioned therethrough, and wherein the cross-sectional area of the second opening is at least smaller than the cross-sectional area of the second hollow member such that the sanitary glove can be retained within the second inner space via the second opening; and a securing mechanism that secures the first end of the first hollow member to the second end of the second hollow member so that when the securing mechanism is engaged, the first and second inner spaces define a single enclosed protected environment for the sanitary gloves.

2. The enclosure of claim 1, wherein the first and second hollow members are dimensioned so as to receive sanitary gloves and retain the gloves within the first and second inner spaces in an environment protected from contaminants.

3. The enclosure of claim 1, wherein the first and second hollow members are configured so that the first and second hollow spaces are rounded in shape so as to define a first and second inner surface respectively.

4. The enclosure of claim 3, wherein the first opening has a cross-sectional area that is less than the cross sectional area of the first hollow member so that the sanitary glove can be positioned within the first inner space and retained within the first inner space as a result of the decreased area of the first opening; and wherein the second opening has a cross-sectional area that is less than the cross sectional area of the second hollow member so that the sanitary glove can be positioned within the second inner space and retained within the second inner space as a result of the decreased area of the second opening.

5. The assembly of claim 3, wherein the first and second openings are sized such that the first and second openings are large enough to allow the user to access the gloves contained in the first and second members with their finger, yet the first and second openings are small enough to inhibit the gloves' ability to escape from the first and second member inadvertently.

6. The enclosure of claim 1, wherein the securing mechanism further comprises a system wherein the second end of the second hollow member fits substantially inside the first end of the first hollow member such that the second opening is open only to the inner space of the first hollow member and the first opening is sealed by the second end of the second hollow member to thereby define the single enclosed protected environment.

7. The enclosure of claim 6, wherein the securing system comprises threads formed on the first and second ends of the first and second hollow members respectively that engage with each other so as to secure the first and second ends together and seal the first and second hollow members to thereby define the single enclosed protected environment.

8. The enclosure of claim 7, wherein the securing system further comprises a first threaded annular protrusion formed on the first hollow member having projected threads and a second threaded annular protrusion formed on the second hollow member having grooved threads wherein the projected threads and the grooved threads mate with each other so as to inhibit entry of contaminants into the enclosed protected environment.

9. The enclosure of claim 1, wherein the first and second hollow members are made out of plastic.

10. The enclosure of claim 1, further comprising a mechanism attached to the first hollow member for securing the enclosure to a belt loop of a user.

11. The enclosure of claim 10, wherein the mechanism is comprised of a beaded chain attached to the first hollow member that can secure the first hollow member to the belt loop of the user.

12. The enclosure of claim 1, further comprising a mechanism attached to the first hollow member for securing the enclosure to a key ring of the user.

13. The enclosure of claim 12, wherein the mechanism is comprised of a beaded chain attached to the first hollow member that can secure the first hollow member to the key chain of the user.

14. The enclosure of claim 1, wherein the enclosed protected space has a volume that is approximately 1 fluid ounce.

15. The enclosure of claim 1, wherein the first and second hollow members are configured so that when they are interconnected, the exterior of the resulting enclosure has the appearance of a peanut.

16. An assembly for retaining a first and a second sanitary gloves, the assembly comprising:

a first member defining a first recess that is sized so as to receive a first sanitary glove wherein the first member includes a first neck portion that defines a first opening that is sized at least smaller than the first recess so as to inhibit the first sanitary glove from falling out of the first recess;

a second member defining a second recess that is sized so as to receive a second sanitary glove wherein the second member includes a second neck portion that defines a second opening that is sized at least smaller than the second recess so as to inhibit the second sanitary glove from falling out of the second recess, wherein the first and second neck portions of the first and second members are configured to be interconnected together such that the first and second openings are closed so as to inhibit entry of foreign particles into the first and second recesses.

17. The assembly of claim 16, wherein the first and second members are configured so that the first and second recesses are rounded in shape.

18. The assembly of claim 17, wherein the first and second openings have a cross-sectional area that is less than the cross-sectional area of the approximately rounded first and second recesses.

19. The assembly of claim 17, wherein the first and second openings are sized such that the first and second openings are large enough to allow the user to access the gloves contained in the first and second members with their finger, yet the first and second openings are small enough to inhibit the gloves' ability to escape from the first and second member inadvertently.

20. The assembly of claim 16, wherein a securing mechanism provides interconnecting means for the first and second members.

21. The assembly of claim 20, wherein the securing mechanism further comprises a system wherein the second end of the second hollow member fits substantially inside the first end of the first hollow member such that the second opening is open only to the inner space of the first hollow member and the first opening is sealed by the second end of the second hollow member to thereby define the single enclosed protected environment.

22. The assembly of claim 21, wherein the securing mechanism comprises threads formed adjacent to the first and second openings of the first and second hollow members respectively that engage with each other so as to secure the first and second hollow members together and enclose the sanitary gloves inside the assembly to thereby inhibit entry of foreign particles into the assembly.

23. The assembly of claim 22, wherein the securing mechanism further comprises a first threaded annular protrusion formed on the first hollow member having projected threads and a second threaded annular protrusion formed on the second hollow member having grooved threads wherein the projected threads and the grooved threads mate with each other so as to inhibit entry of contaminants into the assembly.

24. The assembly of claim 16, wherein the first and second hollow members are made out of plastic.

25. The assembly of claim 16, further comprising a mechanism lying adjacent to the first hollow member for securing the assembly to a belt loop of a user.

26. The assembly of claim 25, wherein the mechanism is comprised of a beaded chain attached to the first hollow member that can secure the first hollow member to the belt loop of the user.

27. The assembly of claim 16, further comprising a mechanism lying adjacent to the first hollow member for securing the assembly to a key ring of the user.

28. The assembly of claim 27, wherein the mechanism is comprised of a beaded chain attached to the first hollow member that can secure the first hollow member to the key chain of the user.

29. The assembly of claim 16, wherein the combined volume of the first and second recess is approximately 1 fluid ounce.

30. The assembly of claim 16, wherein the first and second hollow members are configured so that when they are interconnected, the exterior of the resulting assembly has the appearance of a peanut.

31. A method of storing sanitary gloves for transport comprising:

positioning a sanitary glove inside a first hollow member through a first opening in the first hollow member into a first recess wherein the area of the first opening is smaller than the cross sectional area of the first recess such that the sanitary glove is prevented from escaping the first hollow member;

positioning a sanitary glove inside a second hollow member through a first opening in the second hollow member into a second recess wherein the area of the second opening is smaller than the cross sectional area of the second recess such that the sanitary glove is prevented from escaping the second hollow member; and joining the first hollow member to the second hollow member with a securing mechanism to define a single enclosed protected environment such that the sanitary gloves are individually contained in the first and second hollow members so as to individually encapsulate the sanitary gloves and to isolate the sanitary glove contained in the first hollow member from the sanitary glove contained in the second hollow member to protect them from foreign contaminating particles.

32. The method of claim 31, wherein the first and second hollow members are configured so that the first and second hollow members are approximately rounded in shape.

33. The method of claim 31, wherein the securing mechanism joins the first and second hollow members by rigidly positioning the second opening into the first opening to thereby define the single enclosed protected environment.

34. The method of claim 33, wherein the securing mechanism comprises threads formed on the first and second hollow members respectively that engage with each other so as to secure the first and second hollow members together to thereby define the single enclosed protected environment.

35. The method of claim 34, wherein the securing mechanism comprises a first threaded annular protrusion formed on the first hollow member having projected threads and a second threaded annular protrusion formed on the second hollow member having grooved threads wherein the projected threads and the grooved threads interconnect so as to inhibit entry of the contaminates into the enclosed protected environment.

36. The method of claim 31, wherein the first and second hollow members are made out of plastic.

37. The method of claim 31, wherein the first hollow member further comprises a mechanism for securing the first hollow member to a belt loop of a user.

38. The method of claim 37, wherein the mechanism comprises a beaded chain attached to the first hollow member that can secure the first hollow member to the belt loop of the user.

39. The method of claim 31, wherein the first hollow member further comprises a mechanism for securing the first hollow member to a key ring of a user.

40. The method of claim 39, wherein the mechanism comprises a beaded chain attached to the first hollow member that can secure the first hollow member to the key chain of the user.

41. The method of claim 31, wherein the combined volume of the first and second hollow member is approximately one fluid ounce.

42. The method of claim 31, wherein the first and second hollow members are configured so that when they are interconnected, the exterior of the interconnected first and second hollow members resembles a peanut.

* * * * *